US006694618B1

(12) United States Patent
de Villiers

(10) Patent No.: US 6,694,618 B1
(45) Date of Patent: Feb. 24, 2004

(54) BLADE GRINDING MECHANISM FOR RAZOR

(76) Inventor: Johannes de Villiers, Serena 14, Bellville 7530, Cape Town (ZA)

( * ) Notice: Subject to any disclaimer, the term of this patent is extended or adjusted under 35 U.S.C. 154(b) by 0 days.

(21) Appl. No.: 10/232,377

(22) Filed: Sep. 3, 2002

(51) Int. Cl.[7] ..... B26B 21/50
(52) U.S. Cl. ..... 30/37; 30/41
(58) Field of Search ..... 30/35, 37, 36, 30/41; 76/DIG. 9

(56) References Cited

U.S. PATENT DOCUMENTS 2,065,367 A * 12/1936 Crane ..... 30/37
2,200,246 A * 5/1940 Guimond ..... 30/36
2,530,499 A * 11/1950 Auerbach ..... 30/36
2,933,808 A * 4/1960 Friel et al. ..... 30/37
3,167,888 A * 2/1965 Shanley ..... 30/35 X
4,939,840 A * 7/1990 Butka ..... 30/37
5,461,781 A * 10/1995 Pirc ..... 30/41

* cited by examiner

*Primary Examiner*—Charles Goodman

(57) ABSTRACT

A blade grinding mechanism for a razor consists of a razor dock, at least two razor blades located in the razor dock, and two grinding means located respectively below each of the razor blades in the razor dock. The grinding means has a grinding surface corresponding to the blade edge of the razor blade. After the razor has been used for shaving beards, both of the grinding means can be used to clear the residual beard debris, and be moved to the left and right side to grind and sharpen the blade edge of the razor blade.

6 Claims, 4 Drawing Sheets

BLADE GRINDING MECHANISM FOR RAZOR

FIELD OF THE INVENTION

The present invention relates to a blade grinding mechanism for a razor and particularly a grinding mechanism for clearing beard debris and grinding razor blades.

BACKGROUND OF THE INVENTION

The commonly used double-blade safety razors have two overlapped razor blades located in a razor dock. The two razor blades can be used to shave beards or mustaches at the same time and offer more effective shaving than single blade razors. However, as the gap between the two razor blades is very small, residual beard debris trapped between the razor blades after shaving is difficult to remove and clear. It not only creates sanitary problems, life span of the razor blades also is shortened. Some producers have developed cleaning mechanisms located in the gap of the two razor blades to sweep away the residual beard debris trapped therein. Although such devices can resolve the cleaning problem, they do not help much about another problem of dull blade edges that happens after the razor has been used for a period of time. Thus the razor blades have to be replaced frequently. It becomes a significant waste and expense to users, for the razor blade is usually the most expensive part of the razor.

SUMMARY OF THE INVENTION

Therefore the primary object of the invention is to resolve the aforesaid disadvantages. The invention provides a grinding mechanism that has a grinding surface to grind the blade edges.

To achieve the foregoing object, the blade grinding mechanism of the invention includes a razor dock for housing two pieces of razor blades and two grinding means located respectively below each razor blade. Each grinding means has a grinding surface corresponding to the blade edge of one razor blade. After shaving beards with the razor, the grinding means can be used to sweep and clear the beard debris, and also can be moved to the left and right side to grind and sharpen the blade edges.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
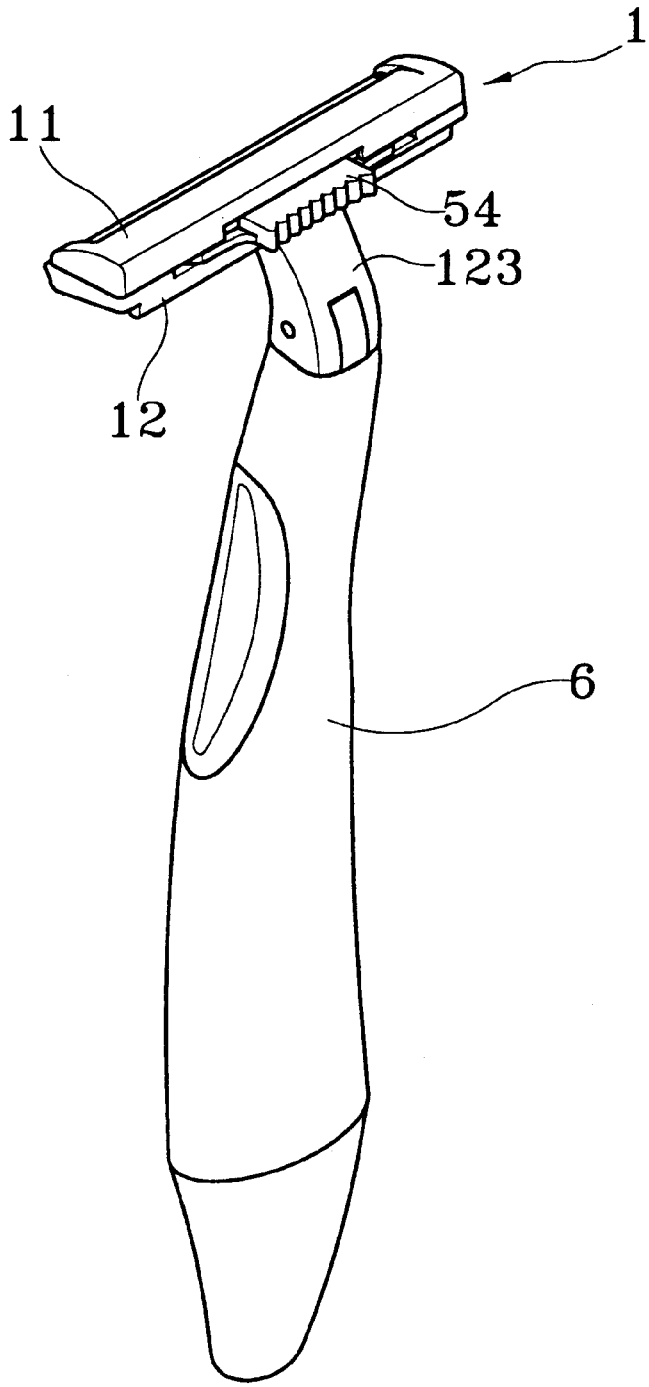
FIG. 1 is a perspective view of the invention.
Figure 2:
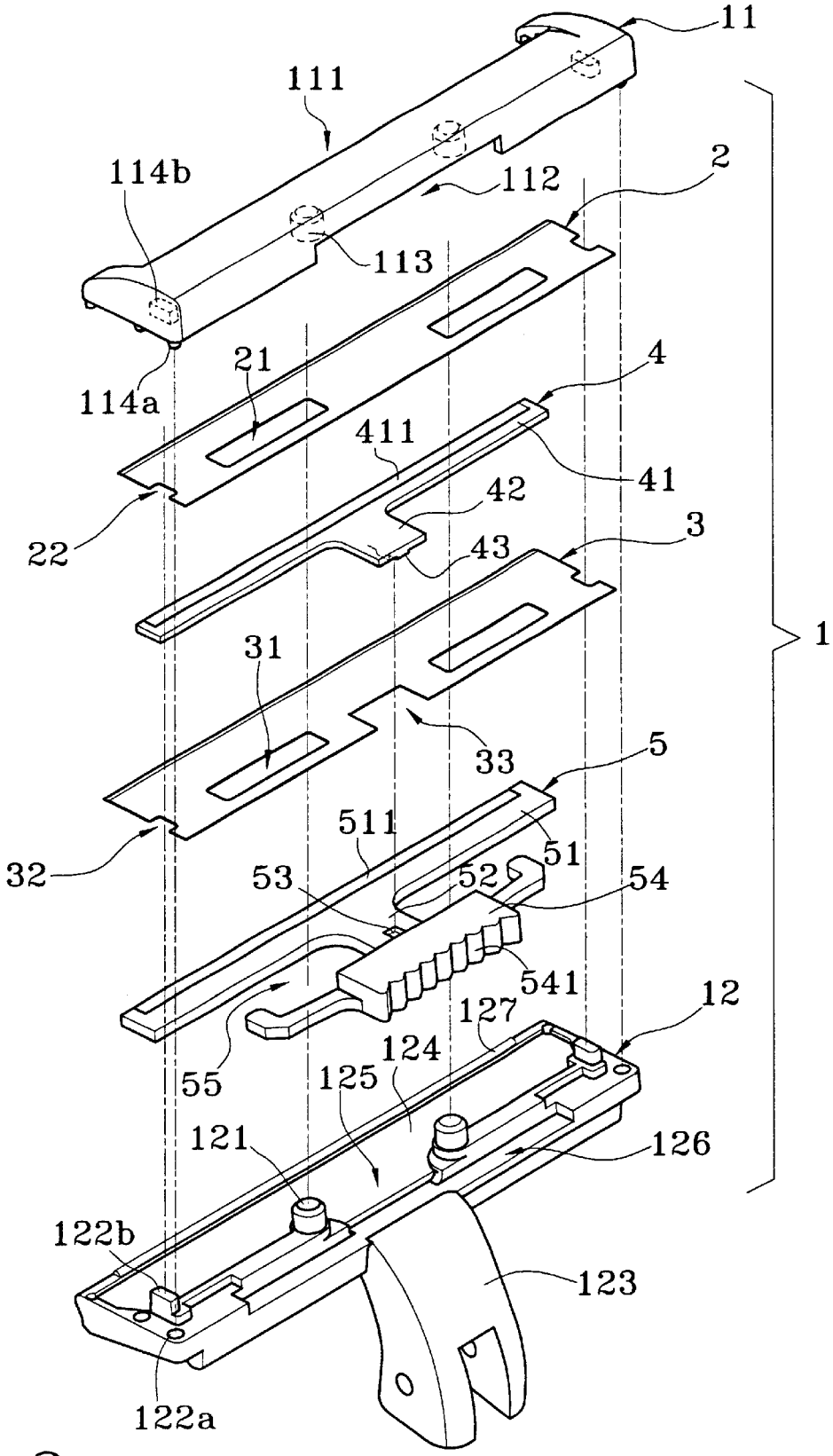
FIG. 2 is an exploded view of the invention.

Referring to FIGS. 1 and 2, the blade grinding mechanism for a razor according to the invention includes a razor dock 1, at least two razor blades 2 and 3 located in the razor dock 1, and two grinding means 4 and 5 located respectively below each of the razor blades 2 and 3. After shaving beards with the razor, the grinding means 4 and 5 may be used to clear the residual beard debris trapped between the two razor blades 2 and 3, and also to grind and sharpen the blade edges of the razor blades 2 and 3.

The razor dock 1 consists of an upper frame 11 and a lower frame 12. The upper frame 11 has a front slot 111 formed at one end thereof to allow the razor blades 2 and 3 to expose outside and a rear slot 112 formed at another end to enable the grinding means 4 and 5 to expose outside. The upper frame 11 and the lower frame 12 further have respectively first coupling sections 113 and 121 corresponding to each other, and second coupling sections 114*a*, 114*b*, 122*a* and 122*b* located respectively at two ends thereof to facilitate a secured coupling between the upper frame 11 and the lower frame 12. The lower frame 12 also has a jutting lug 123 located at a desired position to fasten to a handle 6 of the razor. The lower frame 12 further has a housing space 124 formed on one end for accommodating the razor blades 2 and 3, and the grinding means 4 and 5. The lower frame 12 has another end formed operation troughs 125 and 126 to house necks 42 and 52 that are extended respectively from the grinding means 4 and 5, and an elastic section 54. There is a retain flange 127 formed at one side of the housing space 124 to thoroughly scrape off the beard debris when the grinding means 4 and 5 are being pushed out.

The two razor blades 2 and 3 are located between the upper frame 11 and the lower frame 12, and have respectively loading slots 21 and 31 to enable the first coupling sections 113 and 121 to pass through. The two razor blades 2 and 3 further have respectively notches 22 and 32 formed on two ends thereof to allow the second coupling sections 114*b* and 122*b* to pass through so that the two razor blades 2 and 3 may be held securely in the razor dock 1 after the upper frame 11 and the lower frame 12 are coupled and assembled.

The two grinding means 4 and 5 are located respectively below the razor blades 2 and 3 in the razor dock 1, and have respectively a debris sweeping section 41 and 51 for removing the beard debris trapped between the two razor blades 2 and 3. The debris sweeping sections 41 and 51 connect respectively the necks 42 and 52 that have respectively a cavity 43 and a bulge 53 for coupling with each other so that the two grinding means 4 and 5 may be moved together at the same time. The neck 52 further connects to an elastic section 54 which provides a driving force to return the grinding means 4 and 5 to their original positions after having been pushed out. The elastic section 54 has one end formed a teeth section 541 to enable an user to move the grinding means 4 and 5 to the left and right side more conveniently. There is an operation space 55 formed between the elastic section 54 and the debris sweeping section 51 to enable the grinding means 4 and 5 to move to the left and right side. When the grinding means 4 and 5 are moved to the left or right side, the grinding surfaces 411 and 511 can grind the blade edges of the razor blades 2 and 3. For assembly, place sequentially the two razor blades 2 and 3, and the two grinding means 4 and 5 into the housing space 124 of the lower frame 12, then couple the upper frame 11 with the lower frame 12 to hold the two razor blades 2 and 3, and the two grinding means 4 and 5 securely in the razor dock 1 to form a completed safety razor.

Figure 3A:
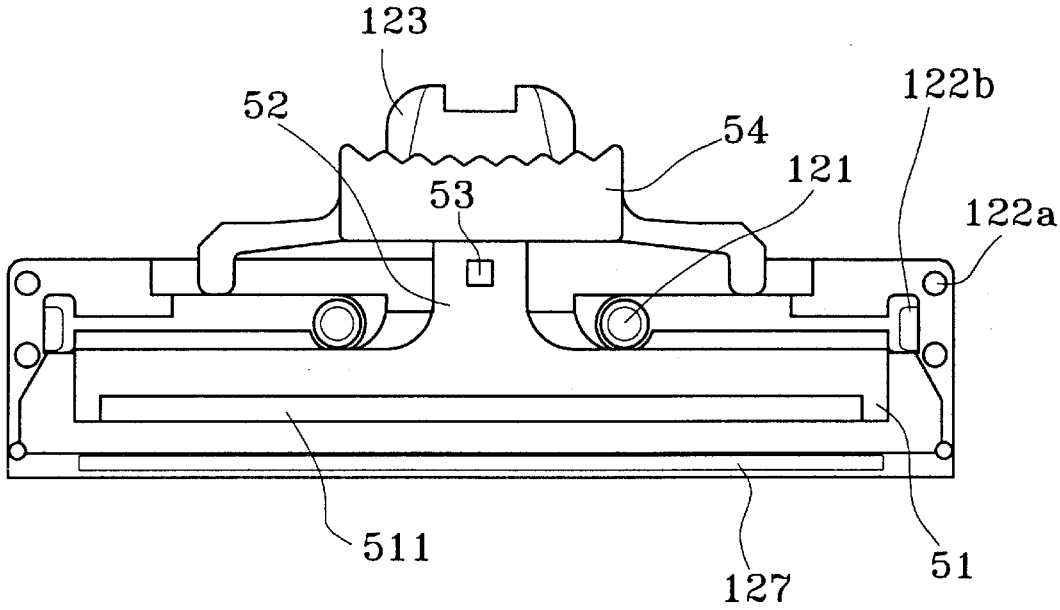
FIGS. 3A and 3B are schematic views of the invention in an operating condition.
Figure 3B:
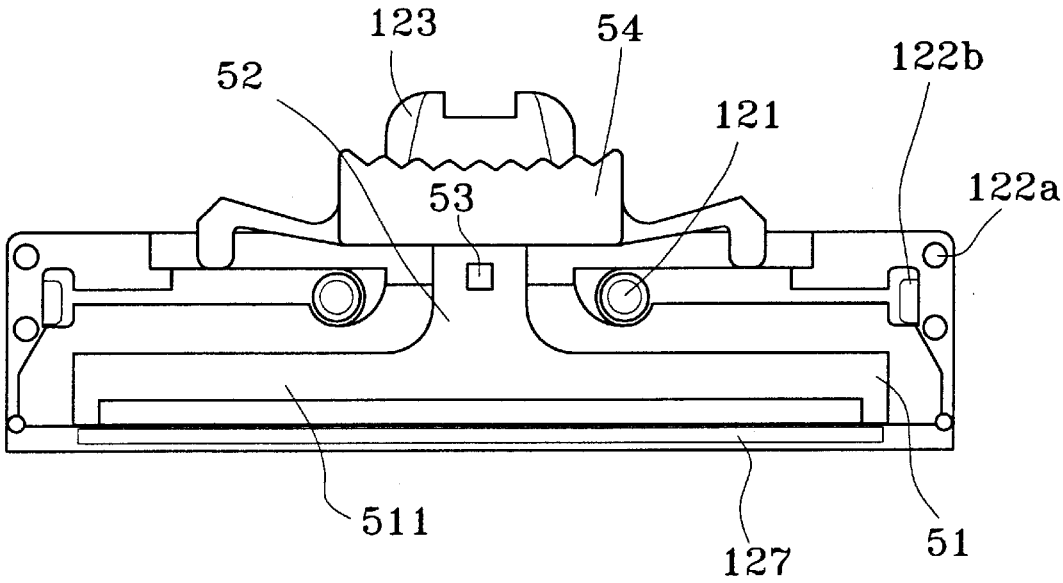

Refer to FIGS. 3A and 3B for an operating condition of the invention. Move the elastic section 54 forwards until reaching the first coupling sections 113 and 121, the debris sweeping sections 41 and 51 may be moved forwards to scrape and sweep off the residual beard debris trapped between the two razor blades 2 and 3.

Figure 4A:
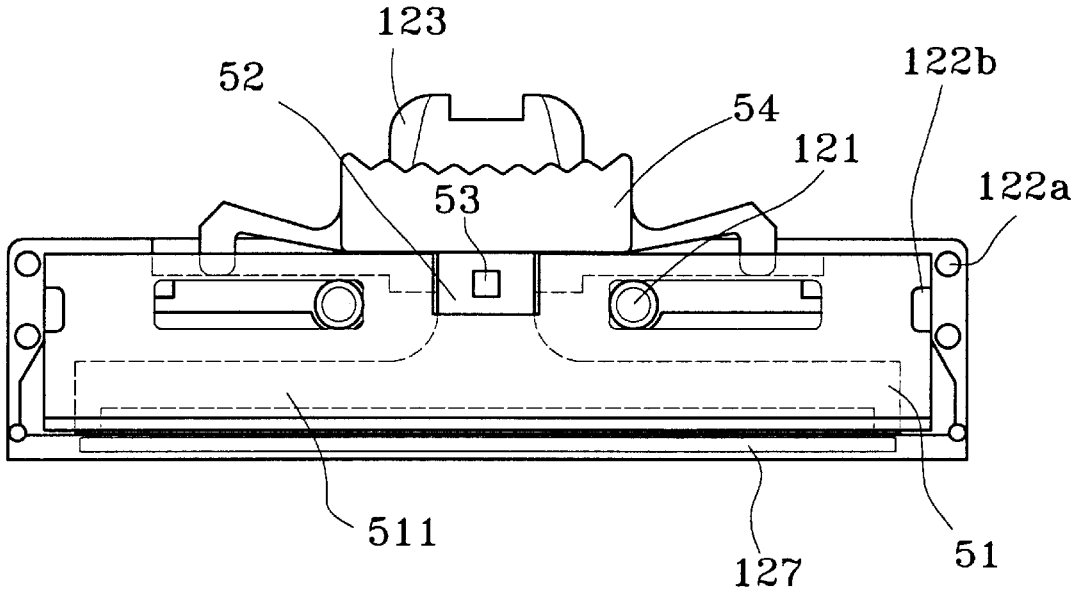
FIGS. 4A and 4B are schematic views of the invention in another operating condition.
Figure 4B:
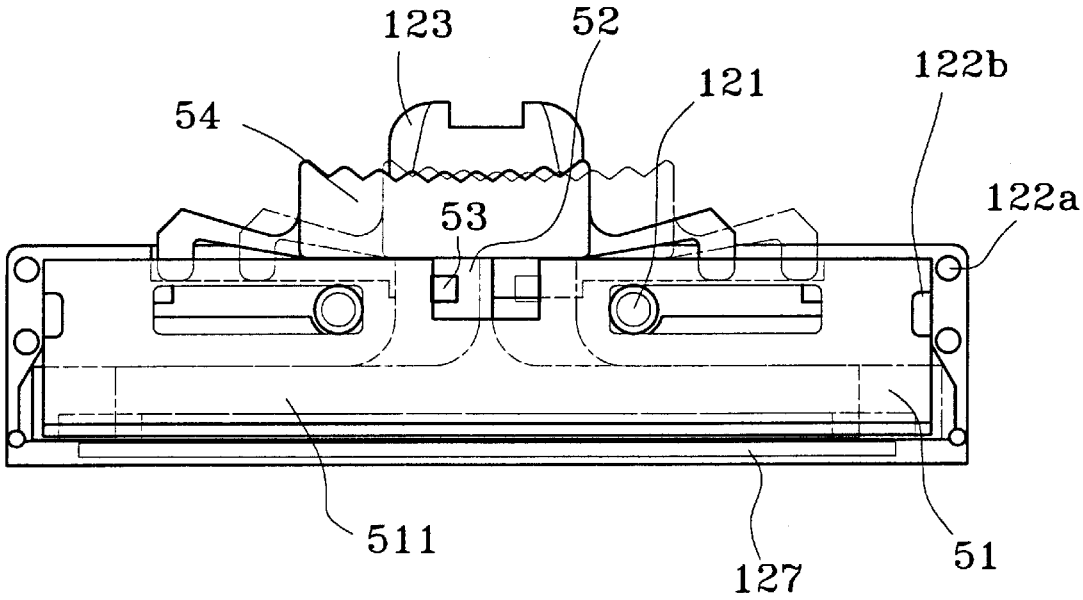

Refer to FIGS. 4A and 4B for another operating condition of the invention. Move the elastic section 54 to the left or right side, the necks 42 and 52 will also be moved sideward in the operation space 55 until reaching the first coupling sections 113 and 121, and the grinding surfaces 411 and 511 of the debris sweeping sections 41 and 51 are moved against the blade edges of the two razor blades 2 and 3. Thus the two razor blades 2 and 3 may be ground and sharpened.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A blade grinding mechanism for a razor, comprising:

a razor dock;

at least two razor blades located in the razor dock; and at least two grinding means located in the razor dock below respectively the razor blades for removing residual beard debris trapped between the two razor blades having respectively a debris sweeping section with a grinding surface formed thereon;

wherein the grinding means are movable to the left and the right side for grinding blade edges of the razor blades.

2. The blade grinding mechanism for a razor of claim 1, wherein the debris sweeping sections connect respectively to a neck, the neck connecting to an elastic section which provides a driving force to return the grinding means to their original positions after having been pushed out.

3. The blade grinding mechanism for a razor of claim 2, wherein the elastic section has one end formed a teeth section to facilitate the moving of the grinding means to the left and the right side.

4. The blade grinding mechanism for a razor of claim 2 further having an operation space located between the elastic section and the debris sweeping section.

5. The blade grinding mechanism for a razor of claim 1, wherein the grinding surface is formed by a ceramic material.

6. The blade grinding mechanism for a razor of claim 1, wherein the grinding surface is formed by metal.

* * * * *